US011330893B2

(12) United States Patent
Goodwin et al.

(10) Patent No.: US 11,330,893 B2
(45) Date of Patent: May 17, 2022

(54) ADJUSTABLE FOOTPRINT SUSPENSION SEAT FRAME SYSTEM

(71) Applicant: Kammok Holdings, LLC, Austin, TX (US)

(72) Inventors: Daniel Goodwin, Austin, TX (US); James Booth, Austin, TX (US)

(73) Assignee: KAMMOK HOLDINGS, LLC, Austin, TX (US)

( * ) Notice: Subject to any disclaimer, the term of this patent is extended or adjusted under 35 U.S.C. 154(b) by 0 days.

(21) Appl. No.: 16/430,027

(22) Filed: Jun. 3, 2019

(65) Prior Publication Data

US 2019/0365085 A1 Dec. 5, 2019

Related U.S. Application Data

(60) Provisional application No. 62/680,378, filed on Jun. 4, 2018.

(51) Int. Cl.

| | |
|---|---|
| ***A47C 3/22*** | (2006.01) |
| ***A45F 3/26*** | (2006.01) |
| ***A45F 3/24*** | (2006.01) |
| ***A47C 7/00*** | (2006.01) |
| *A45F 3/22* | (2006.01) |
| *A47C 3/025* | (2006.01) |

(52) U.S. Cl.

CPC ..... *A45F 3/26* (2013.01); *A45F 3/24* (2013.01); *A47C 7/002* (2013.01); *A45F 3/22* (2013.01); *A47C 3/0255* (2013.01)

(58) Field of Classification Search

CPC ..... A45F 3/26; A45F 3/24; A45F 3/22; A47C 3/0255; A47C 7/002

See application file for complete search history.

(56) References Cited

U.S. PATENT DOCUMENTS

| | | | | | |
|---|---|---|---|---|---|
| 290,921 | A * | 12/1883 | Pluche | A45F 3/24 | 5/129 |
| 950,070 | A * | 2/1910 | Funke | A47C 3/0255 | 5/129 |
| 2,353,220 | A * | 7/1944 | Charlop | A45F 3/24 | 5/128 |
| 4,975,994 | A * | 12/1990 | Barmettler | A45F 3/22 | 5/120 |
| 5,876,011 | A * | 3/1999 | Blasing | F16M 11/16 | 248/411 |
| 6,415,464 | B1 * | 7/2002 | Hsieh | A45F 3/22 | 5/120 |
| 7,082,629 | B2 * | 8/2006 | Clark | A45F 3/24 | 5/127 |
| 7,089,610 | B2 * | 8/2006 | Zhong | A45F 3/24 | 5/122 |
| 2007/0216131 | A1 * | 9/2007 | Potappel | A61G 5/1054 | 280/250.1 |

* cited by examiner

*Primary Examiner* — Syed A Islam

(74) *Attorney, Agent, or Firm* — Loyal IP Law, PLLC; Travis Banta

(57) ABSTRACT

An adjustable-footprint suspension seat frame includes three or more feet, a first cantilever arm with a first anchor for a suspension seat, a second cantilever arm with a second anchor for the suspension seat and a first footprint adjustment bar connecting the first cantilever arm to the second cantilever arm.

19 Claims, 10 Drawing Sheets

ADJUSTABLE FOOTPRINT SUSPENSION SEAT FRAME SYSTEM

CROSS REFERENCE TO RELATED APPLICATION AND CLAIM OF PRIORITY

This application claims priority under 35 U.S.C. § 119(e) to U.S. Provisional Patent Application No. 62/680,378 filed on Jun. 4, 2018. The above-identified provisional patent application is hereby incorporated by reference in its entirety.

TECHNICAL FIELD

This disclosure relates generally to suspension seats, including, without limitation, hammocks and hammock chairs. More specifically, this disclosure relates to an adjustable-footprint suspension seat frame system.

BACKGROUND

Suspension seats, such as hammocks, hammock chairs and other seats which provide support for lying or sitting down while allowing for swinging motion along one or more degrees of freedom, come in a wide variety of sizes and shapes. Likewise, there is a similar heterogeneity in the sizes and shapes of users of suspension seats as well as contexts where use of a suspension seat is desired. Space permitting, suspension seats can provide a viable and comfortable seating option indoors and outdoors. The broad range of users and use contexts for suspension seats presents significant opportunities for improvement in the design of suspension seat frames, both in terms of accommodating heterogeneous users and in terms of adjusting the frames' footprints within a physical space.

SUMMARY

This disclosure provides an adjustable footprint suspension seat system.

In a first embodiment, an adjustable-footprint suspension seat frame includes three or more feet, a first cantilever arm with a first anchor for a suspension seat, a second cantilever arm with a second anchor for the suspension seat and a first footprint adjustment bar connecting the first cantilever arm to the second cantilever arm.

In a second embodiment, an adjustable side clip for a suspension seat includes a hollow collar, the hollow collar having an internal cross section corresponding to an exterior cross section of a cantilever arm of a suspension seat, a suspension seat mount on an exterior portion of the hollow collar and a lock, the lock configured to maintain engagement of the adjustable side clip at a substantially fixed location relative to the cantilever arm of the suspension seat.

In a third embodiment, a footprint adjustment bar includes a length defining member, at a first end of the length defining member, a first connection region of the length defining member having a surface of substantially similar cross section to a counterpart connection region of a first cantilever arm, at a second end of the length defining member, a second connection region of the length defining member having a surface of substantially similar cross section to a counterpart connection region of a second cantilever arm, a first lock to maintain engagement between the length defining member and the first cantilever arm, and a second lock to maintain engagement between the length defining member and the second cantilever arm.

In a fourth embodiment, a footprint adjustment bar includes a first length defining member, the first length defining member having a first end with a first lock and a second end with a second lock, a second length defining member, the second length defining member having a first end and a second end, with a third lock disposed at the second end of the second length defining member, and a locking hinge connecting the second end of the first length defining member with the first end of the second length defining member.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 10, discussed below, and the various embodiments used to describe the principles of this disclosure in this patent document are by way of illustration only and should not be construed in any way to limit the scope of the disclosure.

Figure 1:
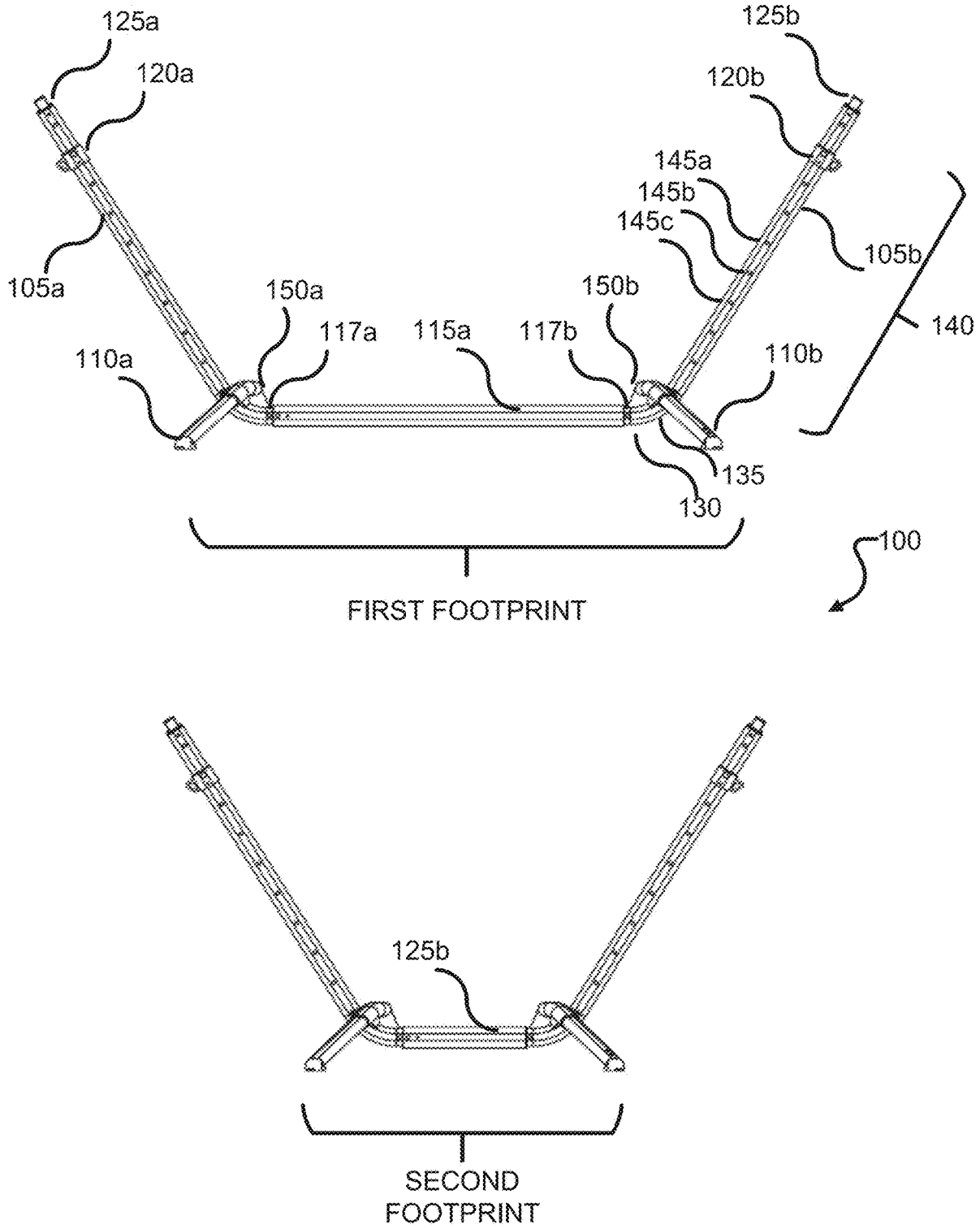
FIG. 1 illustrates an example of an adjustable-footprint suspension seat frame according to certain embodiments of this disclosure.

FIG. 1 illustrates an example of an adjustable-footprint suspension seat frame 100 according to certain embodiments of this disclosure. As noted elsewhere in this disclosure, suspension seats for use with suspension seat frames come in a wide variety of shapes and sizes. Similar variety obtains amongst users of suspension seats and use contexts for suspension seats. Certain embodiments according to this disclosure help meet the varied needs of suspension seat users through structures which add the length of the frame's footprint (as used herein, the term "footprint" encompasses one or more dimensions between the frame's contact points on the ground) as a degree of adjustment for the frame, as well as structures for providing easy, granular adjustment of other structural parameters of the suspension seat frame.

Embodiments according to this disclosure provide an effective solution to certain suspension seat fit problems, including, without limitation, fitting a suspension seat (for example, a hammock or hammock chair) frame in a confined space, such as a dormitory room, or configuring a long hammock to support a lightweight user at a safe or comfortable height above the ground.

Referring to the non-limiting example of FIG. 1, adjustable-footprint suspension seat frame 100 comprises first and second cantilever arms 105*a-b*, first and second pairs of feet 110*a-b*, first and second footprint adjustment bars 115*a-b*, first and second adjustable side clips 120*a-b*, and first and second cradles 125*a-b*. In this particular example, adjustable-footprint suspension seat frame 100 provides a free-standing platform to which the ends of a hammock or other suspension seat may be anchored to first and second adjustable side clips 120*a-b*, and the seat's tensile members (for example, a set of rope lines) passing over first and second cradles 125*a-b* to define a seating area substantially centered between first pair of feet 110*a* and second pair of feet 110*b*.

According to certain embodiments, first and second cantilever arms 105*a-b* comprise sections of a substantially rigid material, including, without limitation, metal tubing (for example, aluminum or steel), carbon fiber, fiberglass, wood or bamboo comprising a connection region 130, a transition region 135 and an extension region 140.

As shown in the non-limiting example of FIG. 1, second cantilever arm 105*b* is constructed from a hollow section of metal tubing having a discorectangular, or obround, cross section. According to embodiments, second cantilever arm 105*b* connects to a footprint adjustment bar (for example, first footprint adjustment bar 115*a*) in a connection region 130 disposed at one end of second cantilever arm 105*b*. To create a strong joint and help second cantilever arm 105*b* resist bowing inwards towards first cantilever arm 105*a* in response to loads generated by a user seated in a suspension seat connected to adjustable side clips 120*a-b*, the centerline of connection region 130 is substantially coaxial with the centerline of the footprint adjustment bar, thereby enabling overlap of material between the footprint adjustment bar and the cantilever arm in connection region 130.

According to embodiments, second cantilever arm 105*b* further comprises a transition region 135, wherein the centerline of the cantilever arm goes from being substantially parallel with first footprint adjustment bar 115*a* to being disposed at an angle (for example, 45 degrees) relative to the centerline of the cantilever arm. In the non-limiting example of FIG. 1, transition region 135 comprises a region of pipe with a short radius (approximately 1 foot) bend. In some embodiments, transition region 135 may be formed by mandrel bending the material comprising the cantilever arm. In some embodiments, to further resist flexion of suspension seat frame 100, one or more reinforcing gussets (for example, reinforcing gusset 150*b*) may be provided in transition region 135. According to other embodiments, transition region 135 may be an abrupt (e.g., a zero radius turn) change in direction, such as may be formed by a welded scarf joint. According to still further embodiments, transition region 135 may have a very large (for example, 4-5 foot) radius, making transition region 135 coextensive with extension region 140.

According to certain embodiments, extension region 140 comprises a portion of second cantilever arm 105*b* which extends upwards and away from connection region 130 to provide one or more points to which a side clip (for example, adjustable side clip 120*b*) can be attached to provide support for a suspension seat. In the non-limiting example of FIG. 1, extension region 140 is shown as being substantially straight, with a single centerline. As noted elsewhere in this disclosure, other embodiments, wherein extension region 140 has a single or compound curve, are possible and within the contemplated scope of this disclosure. According to some embodiments, second cantilever arm 105 may comprise one or more telescoping pieces of material, thereby enabling adjustment of the length of extension region 140.

In the non-limiting example of FIG. 1, extension region 140 is shown as including cradle 125*b* and pin holes 145*a-c*. According to other embodiments, for example, embodiments configured to support short suspension seats which can be anchored on the inside of suspension seat frame 100, cradles 125*a-b* may be omitted. Numerous variations are possible and within the intended scope of this disclosure.

In some embodiments, first and second pairs of feet 110*a*-110*b* comprise sections of substantially rigid material (for example, materials suitable for first and second cantilever arms 105*a-b*) extending outward from anchor points to provide points of ground contact for suspension seat frame 100. In the non-limiting example of FIG. 1, suspension seat frame 100 comprises four legs. Other embodiments, comprising three, five or more legs are possible and within the intended scope of this disclosure. Additionally, in the example of FIG. 1, first and second pairs of feet 110*a*-110*b* are shown as being attached to reinforcing gussets 150*a-b*. According to other embodiments, first and second pairs of feet 110*a*-110*b* may connect to suspension seat frame 100 at different points, including, without limitation on a footprint adjustment bar (for example, first footprint adjustment bar 115*a*).

According to various embodiments, first footprint adjustment bar 115*a* comprises one or more sections of substantially rigid material (for example, materials suitable for first and second cantilever arms) which are attached to first and second cantilever arms 105*a-b*, and maintain the separation between first and second cantilever arms 105*a-b* under loads generated by the user of an attached suspension seat. In the non-limiting example of FIG. 1, first footprint adjustment bar 115*a* detachably attaches to first and second cantilever arms 105*a-b* at points near the connection regions of first and second cantilever arms 105*a-b*. In some embodiments, first footprint adjustment bar 115*a* attaches at one end to first cantilever arm 105*a* via first coupling 117*a*, and attaches at the other end to second cantilever arm 105*b* via second coupling 117*b*. As shown in the non-limiting example of FIG. 1, first footprint adjustment bar 115*a* has a first length, which in conjunction with first and second pairs of feet 110*a-b*, define a first footprint.

According to certain embodiments, at least one of couplings 117*a-b* comprises a pin-hole pair, wherein one half of the pin-hole pair is on first footprint adjustment bar 115*a*, and the other half is on a cantilever arm. According to certain other embodiments, at least one of couplings 117*a-b* comprises a ring clamp disposed on the exterior of a region of overlap (for example, connection region 130) between the first footprint adjustment bar and a cantilever arm. According to still other embodiments, at least one of couplings 117*a-b* comprises a set screw in a region of overlap between the first footprint adjustment bar and a cantilever arm.

As shown in the non-limiting example of FIG. 1, second footprint adjustment bar 115*b* comprises a section of the same material as first footprint adjustment bar 115*a*, only having a different overall length. In this particular example, second footprint adjustment bar 115*b* is shown as having a length that is shorter than that of first footprint adjustment bar 115*a*, resulting in a reduction in the size of the footprint of suspension seat frame 100. As discussed elsewhere in this disclosure, by enabling adjustment of the footprint of the suspension seat frame 100, suspension seat frame 100 can be configured to support an expanded range of suspension seat designs and user profiles (for example, enabling very tall or very light people to use the same suspension seat design).

According to various embodiments, first footprint adjustment bar 115*a* and second footprint adjustment bar 115*b* may comprise part of a set of footprint adjustment bars for use with a particular pair of cantilever arms. Alternatively, first footprint adjustment bar 115*a* may be cut to a length determined to meet the needs of a specific user application (for example, use indoors). According to certain embodiments, each of first and second footprint adjustment bars 115*a-b* comprises the same coupling hardware. Thus, in some embodiments, couplings 117*a-b* comprise pin-hole pairs, and first footprint adjustment bar 115*a* comprises the hole side of the pin-hole pairs, second footprint adjustment bar 115*b* likewise comprises the hole side of the pin-hole pairs. In this way, couplings 117*a-b* operate identically with first and second footprint adjustment bars 115*a-b*.

According to various embodiments, first and second adjustable side clips 120*a-b* comprise first and second anchors for a suspension seat. In the non-limiting example of FIG. 1, each of adjustable side clips 120*a-b* comprises a hollow collar having an interior cross section of substantially similar size and shape as the exterior cross section of first and second cantilever arms 105*a-b*. According to certain embodiments, each of adjustable side clips comprises a lock capable for maintaining engagement of the adjustable side clip at a substantially fixed location relative to the cantilever arm. According to certain embodiments, the lock comprises the pin half of a pin-hole pair, with the hole half disposed on the cantilever arm (for example, pin holes 145*a-c*). According to certain other embodiments, the lock comprises a ring clamp, a set screw or one half of a ratchet-pawl pair, with the other half disposed on the cantilever arm.

In at least one embodiment, first and second cradles 125*a-b* comprise guides disposed at the distal ends of first and second cantilever arms 105*a-b* to support and spread the tensile members of a suspension seat (for example, the ropes of a hammock which converge at the points of attachment to adjustable side clips 120*a-b*, enhancing the comfort and ease of entry to the hammock. Cradles 125*a-b* may be made of any suitable material(s) with the strength to support the load created by the occupant of a suspension seat, and presenting low surface friction (to avoid unnecessary friction and wear on the hammock). Suitable materials for cradles 125*a-b* include, without limitation, DELRIN®, varnished wood and chrome-plated steel.

Although FIG. 1 illustrates one example of an adjustable-footprint suspension seat frame, various changes may be made to FIG. 1. For example, adjustable-footprint suspension seat frame 100 may have more or fewer legs than shown in FIG. 1. Additionally, transition region 135 of second cantilever arm 105*b* may, in certain embodiments, comprise a hinge for adjusting the rise angle of second cantilever arm 105*b* and facilitating breakdown and storage of suspension seat frame 100. Further, in some embodiments, first footprint adjustment bar may be of adjustable length.

Figure 2:
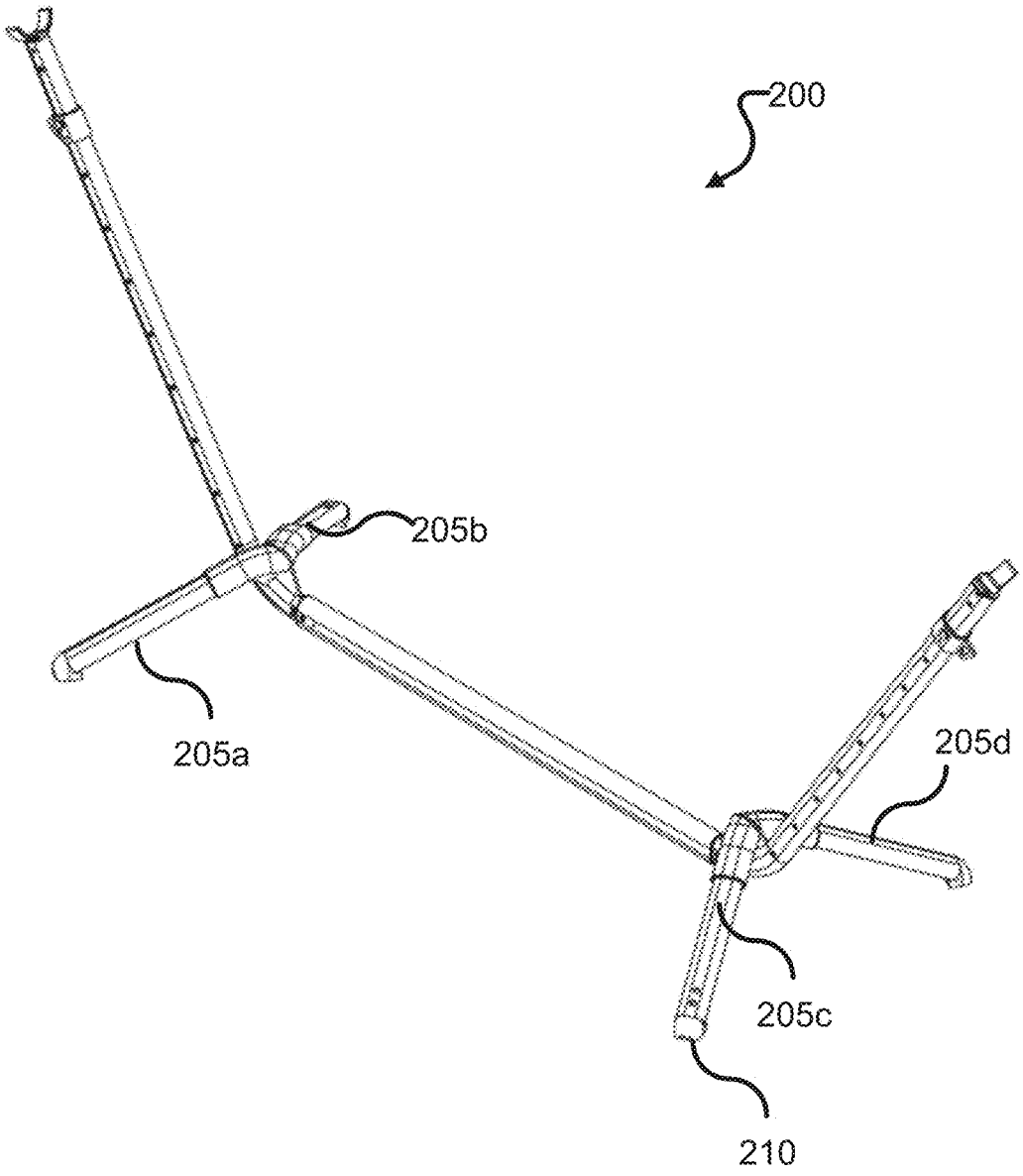
FIG. 2 illustrates an isometric view of an example of an adjustable-footprint suspension seat frame according to various embodiments of this disclosure.

FIG. 2 illustrates an isometric view of an example of an adjustable-footprint suspension seat frame 200 according to certain embodiments of this disclosure.

Referring to the non-limiting example of FIG. 2, adjustable-footprint suspension seat frame 200 comprises legs 205*a*-205*d*. According to embodiments, each of legs 205*a*-205*d* may be detachably attached to the rest of suspension seat frame 200 to facilitate breakdown or storage of the apparatus. Additionally, each of legs 205*a-d* comprises a foot 210. Foot 210 provides a point of contact, or interface, between suspension seat frame 200. According to certain embodiments, foot 210 may be removable and part of an interchangeable set of feet designed for different applications. According to some applications, foot 210 may have a large surface area (for use on soft surfaces, such as at an outdoor concert). According to other embodiments, foot 210 may have one or more felt-covered surfaces, to prevent damage to floors. Alternatively, foot 210 may be made of a low friction material (for example, a plastic suitable for use as a furniture "slider") to facilitate moving the suspension seat frame 200 within a room. Depending on embodiments, foot 210 may be cast, injection molded, carved (such as from wood) or 3-D printed.

Figure 3:
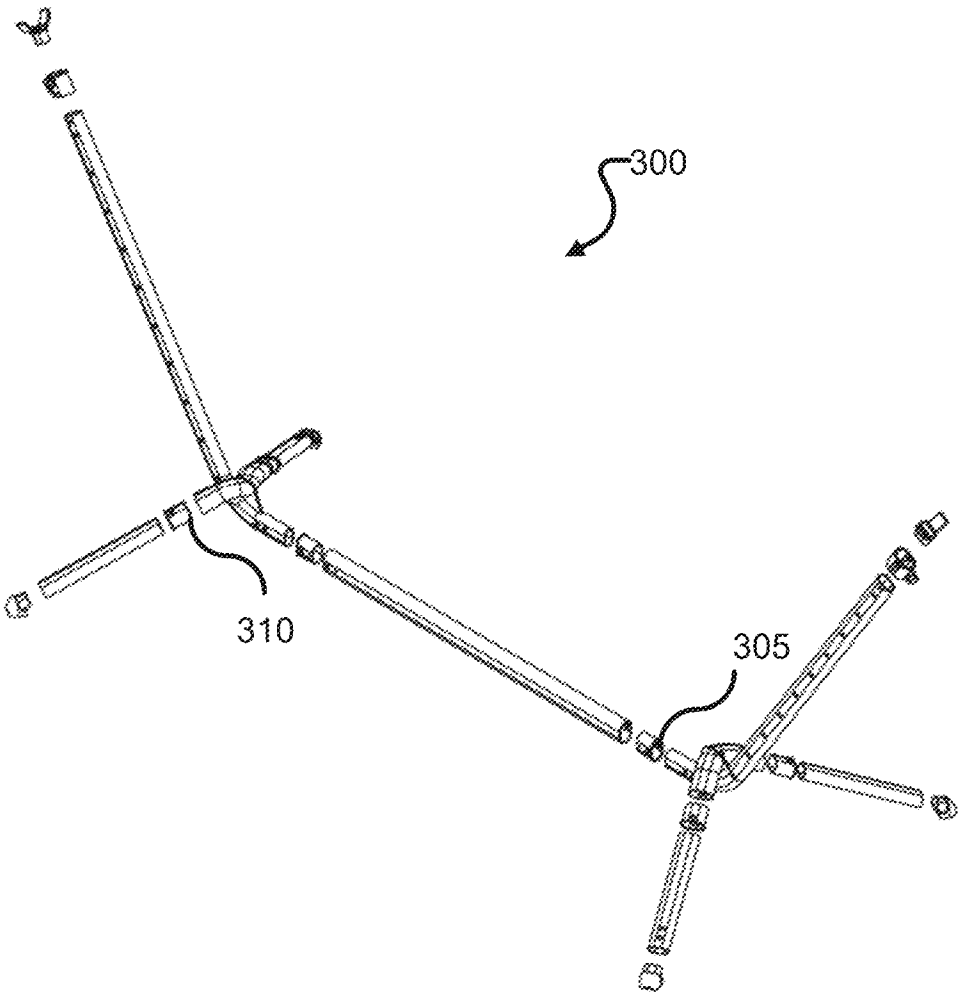
FIG. 3 illustrates an exploded view of an example of an adjustable-footprint suspension seat frame according to various embodiments of this disclosure.

FIG. 3 illustrates an exploded view of an example of an adjustable-footprint suspension seat frame 300 according to various embodiments of this disclosure.

Referring to the non-limiting example of FIG. 3, adjustable-footprint suspension seat frame 300 includes a compression bushing 305 as part of the coupling between a first cantilever arm and a footprint adjustment bar. According to certain embodiments, compression bushing 305 acts as an interface between the metallic surfaces of the cantilever arm and the footprint adjustment bar, preventing loss of material from either component and preventing a metallic first cantilever arm from galling or otherwise becoming stuck to a metallic footprint adjustment bar. Additionally, compression bushing 305 may be made of a suitably compressible material, such as polyurethane, to ensure a tight fit between the footprint adjustment bar and first cantilever arm, eliminating "slop" between the components and contributing to the overall sturdiness of adjustable suspension seat frame 300.

In some embodiments, compressible bushing 305 may be part of a first cantilever arm. According to other embodiments, compressible bushing 305 may be part of a footprint adjustment bar. According to still other embodiments, compressible bushing 305 may be part of a separate device for coupling a footprint adjustment bar to a first cantilever arm.

According to certain other embodiments, adjustable footprint suspension seat frame 300 comprises one or more compressible bushings 310 at the point of union between the leg and the rest of adjustable footprint suspension seat frame 300.

Figure 4:
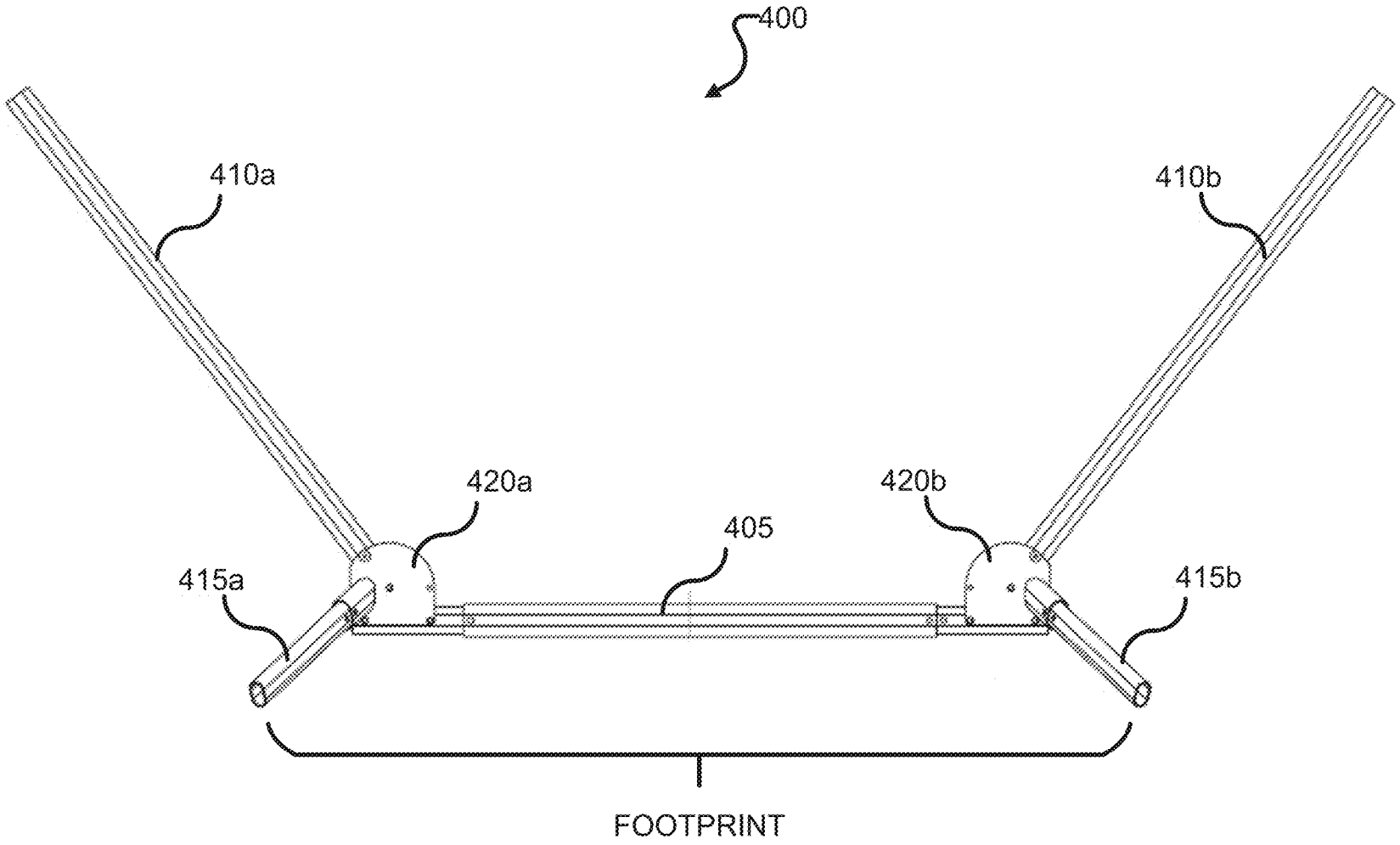
FIG. 4 illustrates an example of an adjustable-footprint suspension seat frame according to some embodiments of this disclosure.

FIG. 4 illustrates an example 400 of an adjustable-footprint suspension seat frame 400 according to various embodiments of this disclosure.

Referring to the non-limiting example of FIG. 4, adjustable-footprint suspension seat frame 400 comprises a first footprint adjustment bar 405, first and second cantilever arms 410*a-b*, first and second leg pairs 415*a-b* and transition hinges 420*a-b*.

According to certain embodiments, first footprint adjustment bar 405 connects to cantilever arms 410*a-b* through transition hinges 420*a-b*. In this particular example, the footprint (as used in this disclosure, the term "footprint" is understood to encompass the dimensions between the points of contact between suspension seat frame 400 and a supporting surface, such as a floor or the ground) of the suspension seat frame 400 is defined by, inter alia, the current length of first footprint adjustment bar 405.

In this illustrative example, first footprint adjustment bar 405 comprises one or more structures which enable adjustment of the length of first footprint adjustment bar 405, such that adjustable-footprint suspension seat frame 400 may be operated at two or more footprint sizes with first footprint adjustment bar 405. As an example, first footprint adjustment bar 405 comprises two or more concentric members which can telescope relative to one another. According to such embodiments, first footprint adjustment bar 405 may comprise a first section and a second section, wherein the first section is substantially concentric to the second section and configured to move telescopically within the second section and configured to move telescopically (e.g., back and forth relative to each other) within the second section. Further, the first section is configured to operably engage with (to prevent movement of the first and second sections during use) to define two or more working lengths of the first footprint adjustment bar.

Operable engagement between the first and second sections of first footprint adjustment bar 405 is, in some embodiments, achieved by providing the second section with one or more holes for a pin-hole pair, and by providing the first section with at least one locking pin configured to pass through the locking pin hole to inhibit telescopic movement and substantially maintain the working length of first footprint adjustment bar 405. In other embodiments, operable engagement between the first and second sections of first footprint adjustment bar 405 is achieved by providing the second section with a ring clamp (for example, a "quick release" style ring clamp, such as used to provide easy adjustment of bicycle seat posts) to hold an interior surface of the second section against an exterior surface of the first section.

In some embodiments, adjustments in the length of first footprint adjustment bar 405 can be achieved by providing a first threaded member having a centerline substantially parallel to a longitudinal (e.g., lengthwise) axis of first footprint adjustment bar 405. In one example, the first threaded member has, at one end, a coupling portion suitable for attachment to a cantilever arm, or a length of material which connects to a cantilever arm. In this example, the first threaded member has, at the opposite end, a threaded portion (for example, a threaded rod, a nut, or a region where the material of the first threaded member has been bent or formed to provide threads). In this non-limiting example, first footprint adjustment bar 405 further comprises a second threaded member having a substantially parallel to a longitudinal (e.g., lengthwise) axis of first footprint adjustment bar 405. The second threaded member has, at one end, a coupling portion suitable for attachment to a cantilever arm, or a length of material which connects to a cantilever arm. In this example, the second threaded member has, at the opposite end, a threaded portion (for example, a threaded rod, a nut, or a region where the material of the first threaded member has been bent or formed to provide threads). According to some embodiments, the threaded portion of the first section engages directly with the threaded portion of the second section. According to other embodiments, the threaded portion of the first section is connected indirectly (for example, by a rod having a region with threads in one direction and another region with threads in another direction) by a third threaded member.

According to certain other embodiments, the length of first footprint adjustment bar 405 may be adjusted by other suitable length control mechanisms, including, without limitation, a first member having one half of a ratchet-pawl pair, and a second member having the other half of the ratchet-pawl pair.

In various embodiments according to this disclosure, first and second cantilever arms 410*a-b* comprise lengths of material (for example, circular, rectangular, polygonal or obround section metal tubing) of sufficient strength to provide cantilevered support to resist loads generated by the use of a suspension seat. In this non-limiting example, first and second cantilever arms 410*a-b* do not include holes for pin-hole pairs. In this particular example, first and second cantilever arms 410*a-b* are designed to pair with adjustable side clips which operably engage with first and second cantilever arms through friction (for example, friction provided by a set screw or a ring clamp).

According to various embodiments of this disclosure, first and second cantilever arms 410*a-b* connect to transition hinges 420*a-b*, and are maintained at an operable angle by transition hinges 420*a-b*.

In some embodiments, first and second leg pairs 415*a-b* comprise removable legs attached to transition hinges 420*a-b*. According to other embodiments, adjustable-footprint suspension seat frame 400 has only three legs, instead of the four legs shown in the non-limiting example of FIG. 4. Alternatively, in other embodiments, one or more legs of first and second leg pairs 415*a-b* attaches to adjustable-footprint suspension seat frame 400 at points outside of transition hinges 420*a-b*. In some embodiments, first and second leg pairs 415*a-b* attach to first footprint adjustment bar 405. In other embodiments, first and second leg pairs 415*a-b* attach to first and second cantilever arms 410*a-b*.

As shown in the non-limiting example of FIG. 4, adjustable-footprint suspension seat frame 400 comprises first and second transition hinges 420*a-b*. According to certain embodiments, first and second transition hinges 420*a-b* connect connection regions to pivoting cantilever arms (for example cantilever arms 410*a-b*). In some embodiments, first and second transition hinges 420*a-b* comprise a pivot point and locks (for example, holes for pin-hole pairs) to hold a cantilever arm in position at a variety of operating angles.

Figure 5:
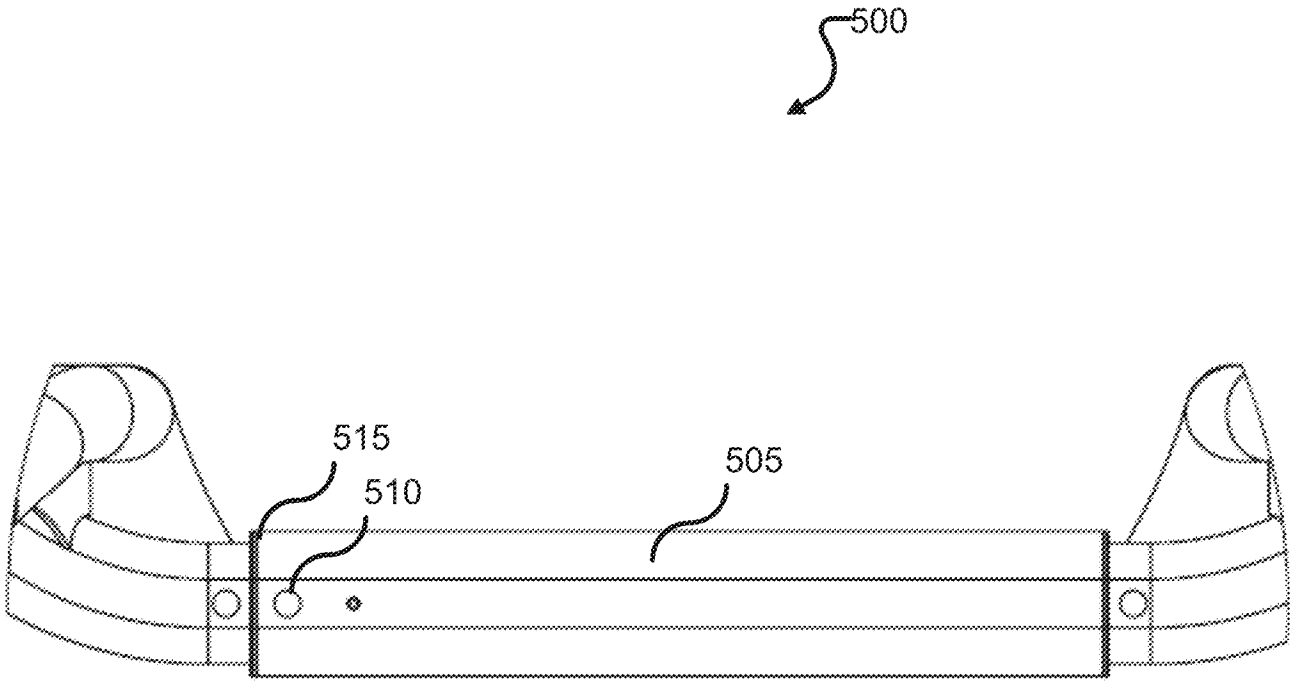
FIG. 5 illustrates an example of a footprint adjustment bar according to certain embodiments of this disclosure.

FIG. 5 illustrates an example of a footprint adjustment bar 500 according to certain embodiments of this disclosure.

According to certain embodiments, footprint adjustment bar 500 comprises one footprint adjustment bar of a set of footprint adjustment bars configured to interface with a set of common cantilever arms. According to other embodiments, footprint adjustment bar 500 is a retrofit component designed to interface with hardware of an existing suspension seat frame in order to provide a different sized footprint.

According to certain embodiments, footprint adjustment bar 500 comprises a length-defining member 505. In the non-limiting example of FIG. 5, length-defining member 505 comprises a single length of material (in this case, a section of metal tubing with an obround cross section) that defines the change in the footprint of an adjustable footprint suspension seat frame. For example, if the length of length-defining member 505 is increased by a foot, the length of the footprint of the adjustable footprint suspension seat frame in which it resides is similarly increased by a foot.

In some embodiments, length-defining member 505 comprises a single section of material. In other embodiments, length-defining member 505 comprises two or more lengths of material with centerlines substantially parallel to a common longitudinal axis, which can move relative to one another to change the overall length of length-defining member 505. According to certain embodiments, the two sections of material may be concentric and move telescopically relative to one another. According to other embodiments, the two sections may be parallel to one another, and connected by one or more crossbars which attach to one section, and allow the other section to pass through.

In the non-limiting example of FIG. 5, footprint adjustment bar 500 includes a lock 510 coupling footprint adjustment bar 500 to other components of an adjustable-footprint suspension seat frame. According to certain embodiments, lock 510 comprises one half of a pin-hole pair. Other embodiments are within the contemplated scope of this disclosure, such as embodiments, wherein lock 510 comprises a ring clamp or a set screw).

In some embodiments, footprint adjustment bar 500 further comprises a compressible bushing 515. According to certain embodiments, compressible bushing 515 covers one or more surfaces of footprint adjustment bar 500 in a region where footprint adjustment bar 500 mates with another component of a suspension frame (for example, cantilever arms or a transition hinge). In certain embodiments, compressible bushing 515 is formed of a hard plastic which helps eliminate "slop" between suspension seat frame components under load, and eliminates galling or other sources of friction and sticking between metal components.

Footprint adjustment bar 500 provides one example of a footprint adjustment bar according to this disclosure. Other embodiments are possible and within the intended scope of this disclosure. For example, according to certain embodiments, a footprint adjustment bar may be constructed from two lengths of material connected by a locking hinge. Further, the first length of material has locks at both ends, and the second length of material has, at a minimum, a lock at an end disposed away from the locking hinge. Accordingly, a footprint adjustment bar according to such embodiments supports at least two footprints. A first footprint may be defined when the locking hinge is fully opened, and the two lengths of material abut one another at their ends. A second footprint may be defined when the locking hinge is fully closed, and the cantilever arms of a suspension seat frame are connected to the locks at the ends of the first length of material.

Figure 6:
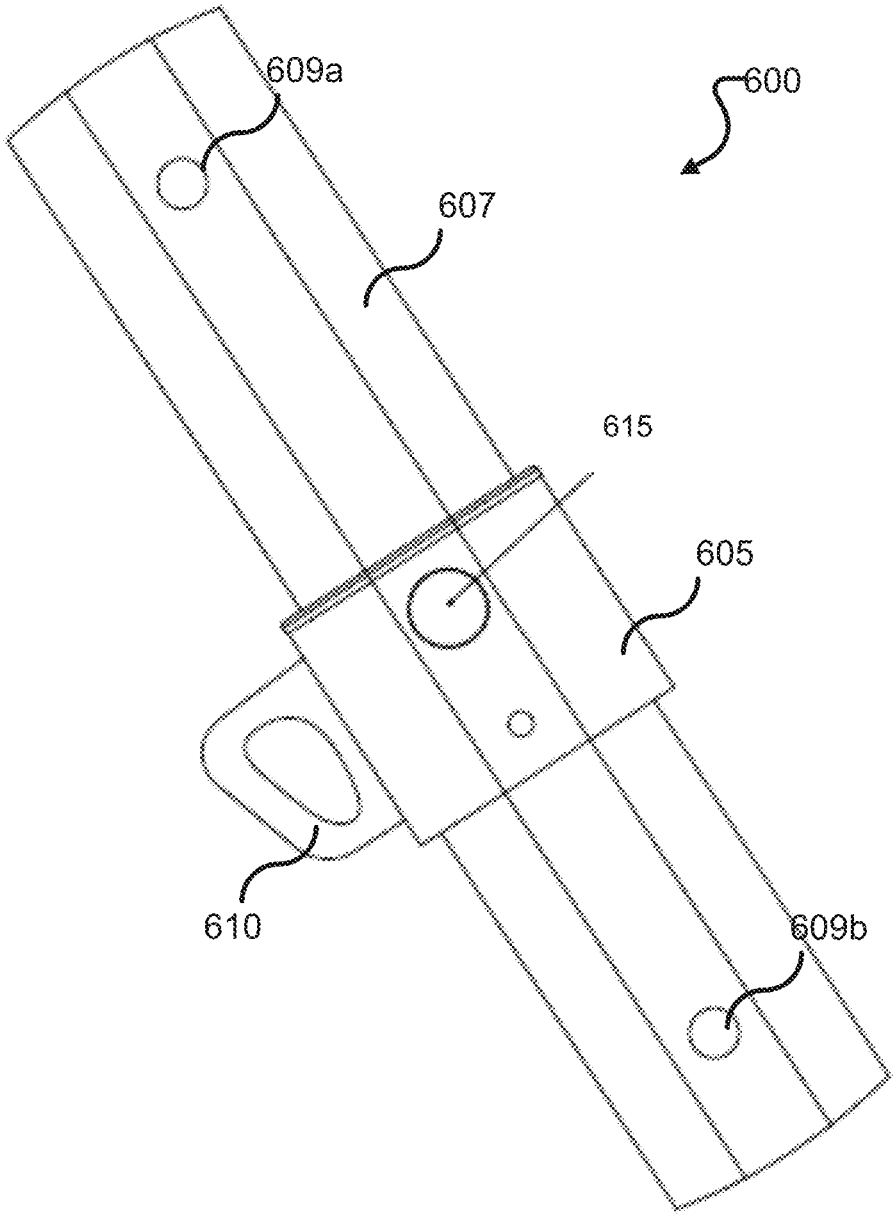
FIG. 6 illustrates an example of a side clip according to various embodiments of this disclosure.

FIG. 6 illustrates an adjustable side clip 600 for a suspension seat according to various embodiments of this disclosure.

Referring to the non-limiting example of FIG. 6, adjustable side clip 600 operates as an attachment for one end of a suspension seat at one or more positions 609*a* and 609*b* along a cantilever arm 607 of a suspension seat frame.

According to certain embodiments, adjustable side clip 600 comprises a hollow collar 605. Hollow collar 605 may be constructed of any material with sufficient strength to support both the tensile load from the suspension seat provided through suspension seat mount 610, as well as the sheer load provided through lock 615. Suitable materials for hollow collar 605 include, without limitation, steel, aluminum, titanium, polyphthalamide, or high density polyethylene (HDPE). According to various embodiments, hollow collar 615 has an interior cross section of similar shape and profile to that of cantilever arm 607, thereby allowing adjustable side clip 600 to slide between mounting positions and also maintain a tight, slop-free fit during use. In some embodiments, the interior surface of hollow collar 605 may comprise one or more internal rings, or areas of reduced cross section, to help ensure a slop-free fit between adjustable side clip 600 and cantilever arm 607.

In some embodiments, adjustable side clip 600 comprises a suspension seat mount 610 on an exterior portion of hollow collar 605. According to certain embodiments, suspension seat mount 610 may be integral to hollow collar 605, with both components being cast, molded or otherwise formed as one unit. According to certain embodiments, suspension seat mount 610 comprises a ring, hook, or horizontal bar having a cross section that is slender enough to allow engagement with a corresponding hook, ring, carabiner or other mounting hardware on the suspension seat, but also strong enough to withstand the tensile force generated by the suspension seat under load. According to some embodiments, such as when mounted on a suspension seat frame which includes a cradle (for example, cradle 125*a* in FIG. 1), suspension seat mount 610 is disposed on the outside (relative to the occupant of the suspension seat) of the suspension seat frame. According to other embodiments, such as when mounted on a suspension seat frame which does not use a cradle, suspension seat mount 610 is disposed on the inside of the suspension seat frame. In some cases, hollow collar 605 has an internal cross section that is symmetric about multiple axes, thereby permitting adjustable side clip 600 to operate with suspension seat mount 610 facing inwards or outwards.

As shown in the non-limiting example of FIG. 6, adjustable side clip 600 comprises a lock 615. In the non-limiting example of FIG. 6, lock 615 comprises one half of a pin-hole pair, wherein the pin is included as part of adjustable side clip 600, and mates with holes (for example, the hole at position 609*a*) provided on cantilever arm 607. According to other embodiments, lock 615 is, without limitation, a ring clamp, a set, or grub screw, or one half of a ratchet-pawl pair.

Figure 7:
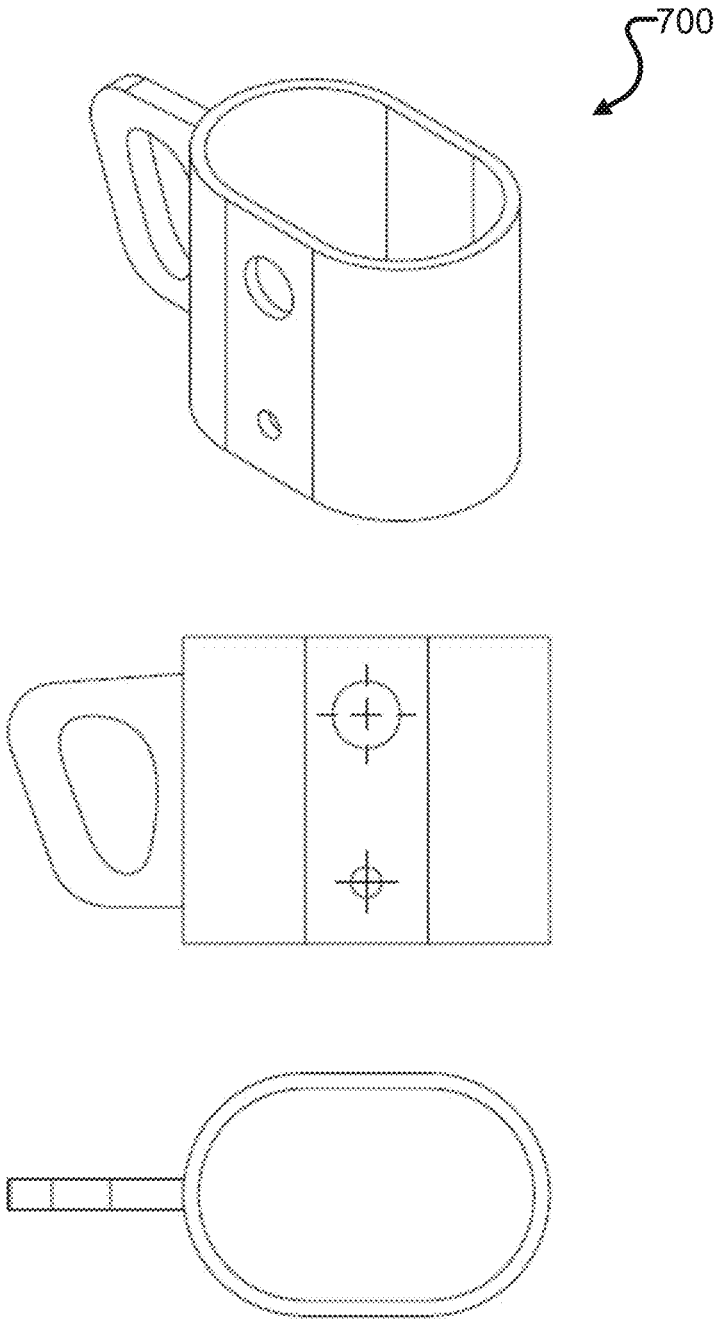
FIG. 7 illustrates an example of a side clip according to some embodiments of this disclosure.

FIG. 7 provides multiple views of an example of an adjustable side clip 700 according to various embodiments of this disclosure.

Figure 8:
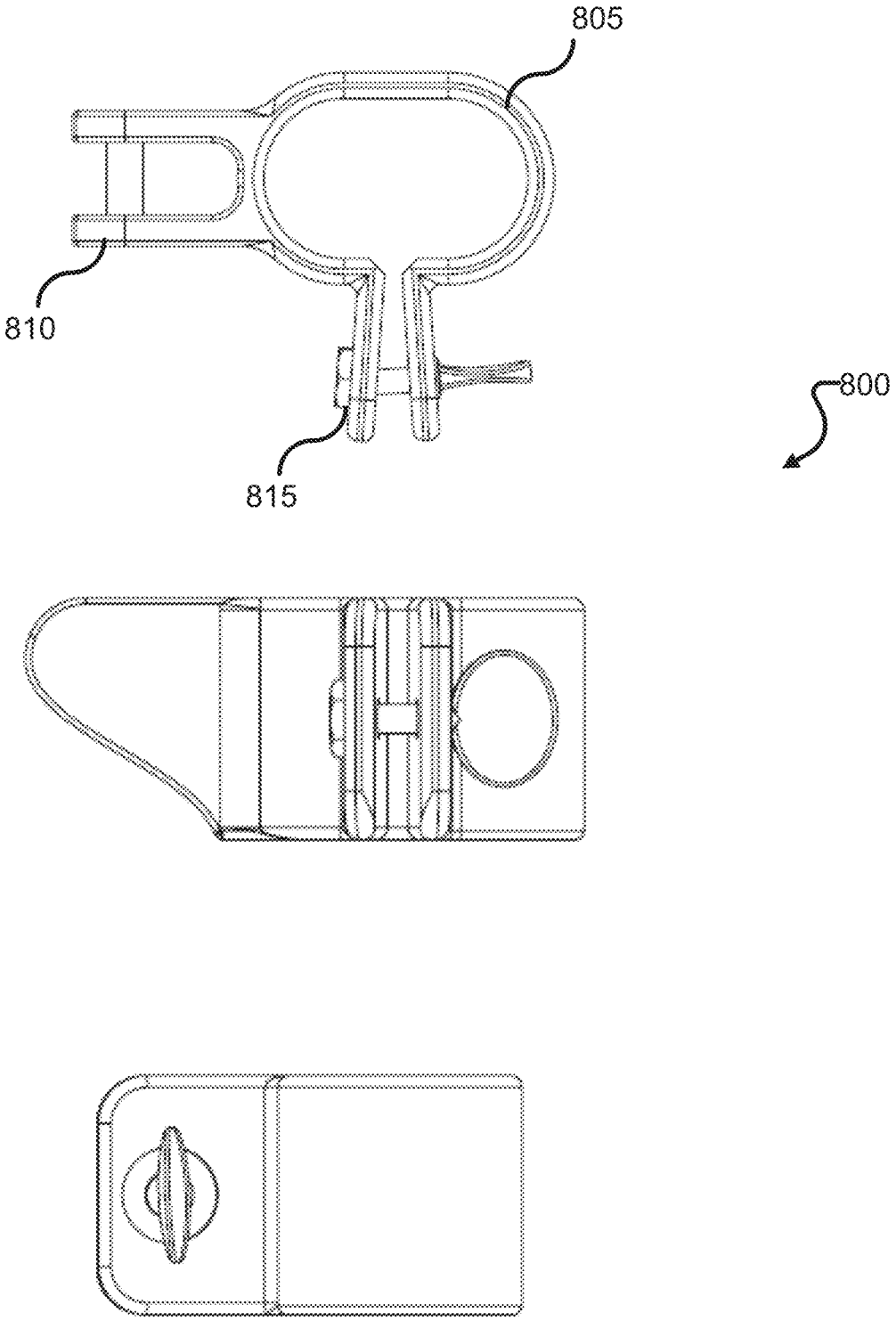
FIG. 8 illustrates an example of a side clip according to certain embodiments of this disclosure.

FIG. 8 provides multiple views of an adjustable side clip 800 according to various embodiments of this disclosure. As shown in the non-limiting example of FIG. 8, hollow collar 815 has an open cross section, the terminal portions of which engage with a tensioning screw to form lock 815. Further, in the non-limiting example of FIG. 8, suspension seat mount 810 comprises a horizontal cylindrical section between two vertical flanges.

Figure 9:
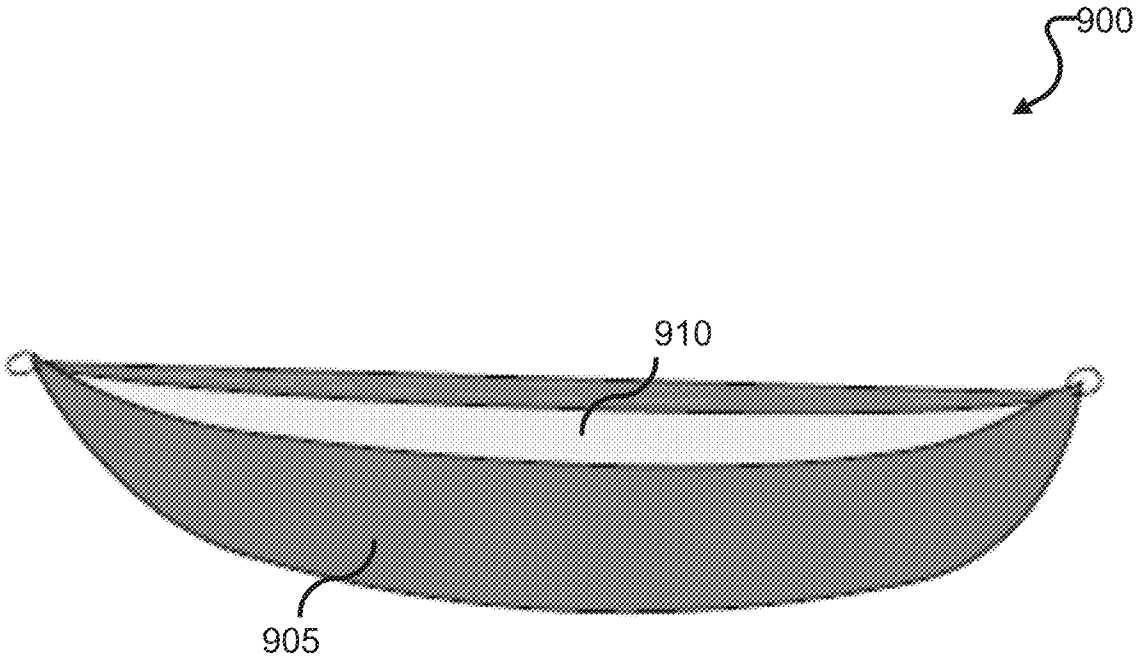
FIG. 9 illustrates an example of a suspension seat with an integrated blanket according to some embodiments of this disclosure.

FIG. 9 illustrates a suspension seat 900 with integrated blanket according to certain embodiments of this disclosure.

By their nature, suspension seats expand and contract during in response to a user's movements. Further, by their nature, suspension seats tend to have a narrow top width. As such, conventional blankets are generally unsuitable for use with suspension seats, in particular, hammocks. A conventional width blanket, such as a picnic blanket or bed blanket will likely be unduly wide, and drag on the ground at the edges, getting dirty and potentially providing passage for bugs, sticks and other unwanted material into the suspension seat. Conversely, a blanket sized to fit the width of a suspension seat will likely leave the user partially exposed, due to the inherent motion of the seat.

Certain embodiments of a suspension seat 900 according to this disclosure address these problems by providing a suspension seat, for example, a hammock, with an integrated blanket. As shown in the non-limiting example of FIG. 9, suspension seat 900 comprises a support portion 905 and an integrated blanket 910. In some embodiments, support portion 905 comprises a large (for example 7'×4') section of a flexible material having good tensile strength, such as canvas, cotton duck, rope mesh that converges at the ends for attachment to a suspension seat frame, a tree, or other supporting member. According to various embodiments, support portion 905 is formed by gathering the end portions of a substantially rectangular piece of material.

As shown in the non-limiting example of FIG. 9, integrated blanket 910 comprises a length of an insulating material, which in certain embodiments, has some elasticity. Suitable materials for integrated blanket 910 include, without limitation, fleece, wool, and quilting, such as a layer of down or polyfil retained between two sheets. According to certain embodiments, integrated blanket 910 is attached to support portion 905 along the edges of the seat. Suitable methods of attachment include, without limitation, zippers, Velcro, snaps and stitching.

Figure 10:
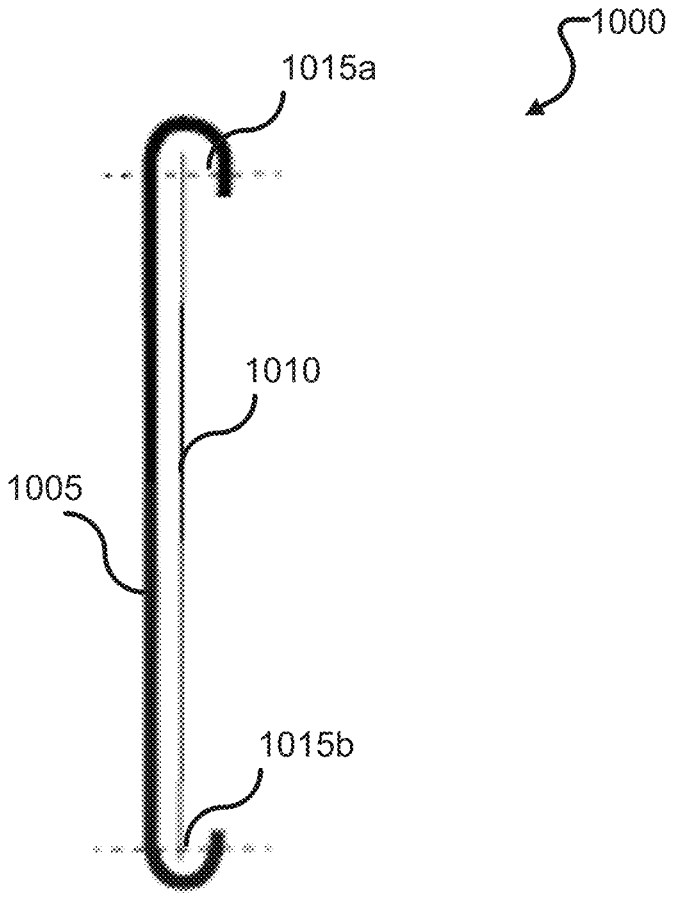
FIG. 10 illustrates an example of a suspension seat with an integrated blanket according to at least one embodiment of this disclosure.

FIG. 10 illustrates, via a cross sectional view, the construction of a suspension seat 1000 comprising an integrated blanket according to various embodiments of this disclosure. According to certain embodiments, suspension seat 1000 comprises a support member 1005, an integrated blanket 1010. As shown in the non-limiting example of FIG. 10, support member 1005 and integrated blanket 1010 are joined, at minimum, along the longitudinal edges of the support seat via a pair of sew lines 1015*a-b*.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any sub combination. Further, references to values stated in ranges include each and every value within that range.

What is claimed is:

1. An adjustable-footprint suspension seat frame comprising:

three or more feet;

a first cantilever arm comprising a first cradle disposed on a distal end of the first cantilever arm and a side clip including a first anchor for a suspension seat oriented on a backside of the first cantilever arm, wherein the first cantilever arm extends through the side clip and the side clip slides proximally and distally along the first cantilever arm;

a second cantilever arm comprising a second cradle disposed on a distal end of the second cantilever arm and a second anchor for the suspension seat oriented on a backside of the second cantilever arm; and a first footprint adjustment bar connecting the first cantilever arm to the second cantilever arm.

2. The adjustable-footprint suspension seat frame of claim 1, further comprising:

a first coupling on the first cantilever arm detachably attaching the first cantilever arm to the first footprint adjustment bar;

a second coupling on the second cantilever arm detachably attaching the second cantilever arm to the first footprint adjustment bar; and wherein the first footprint adjustment bar has a first length and comprises one of a plurality of footprint adjustment bars, each bar of the plurality of footprint adjustment bars having a length and configured to detachably attach to the first cantilever arm at a first end and detachably attach to the second cantilever arm at a second end.

3. The adjustable-footprint suspension seat frame of claim 2, wherein the first coupling comprises a compressible bushing.

4. The adjustable-footprint suspension seat frame of claim 2, wherein the first footprint adjustment bar comprises a compressible bushing, the compressible bushing having a cross section of substantially similar size and shape to a cross section of the first coupling.

5. The adjustable-footprint suspension seat frame of claim 1, wherein:

the first footprint adjustment bar comprises a first section and a second section;

wherein the first section is substantially concentric to the second section and configured to move telescopically within the second section, and wherein the first section is configured to operably engage with the second section to define two or more working lengths of the first footprint adjustment bar.

6. The adjustable-footprint suspension seat frame of claim 5, wherein:

the second section comprises at least one locking pin hole; and the first section comprises at least one locking pin configures to pass through the at least one locking pin hole and substantially maintain a working length of the first footprint adjustment bar.

7. The adjustable-footprint suspension seat frame of claim 1, wherein:

the first cantilever arm comprises a folding joint for adjusting an angle of the first cantilever arm relative to the first footprint adjustment bar.

8. The adjustable-footprint suspension seat frame of claim 1, wherein the first cantilever arm and the second cantilever arm each include a plurality of pin holes.

9. The adjustable-footprint suspension seat frame of claim 8, wherein the plurality of pin holes are disposed along a length of the first cantilever arm and a length of the second cantilever arm.

10. The adjustable-footprint suspension seat frame of claim 8, wherein the first anchor interlocks with the first cantilever arm at one of the plurality of pin holes on the first cantilever arm.

11. The adjustable-footprint suspension seat frame of claim 8, wherein the second anchor interlocks with the second cantilever arm at one of the plurality of pin holes on the second cantilever arm.

12. The adjustable-footprint suspension seat frame of claim 8, wherein the first anchor engages the first cantilever arm and slides distally and proximally along the first cantilever arm as the side clip slides proximally and distally along the first cantilever arm.

13. The adjustable-footprint suspension seat frame of claim 12, wherein the second anchor engages the second cantilever arm and slides distally and proximally along the second cantilever arm.

14. The adjustable-footprint suspension seat frame of claim 1, wherein the first cradle and the second cradle each include line guides.

15. The adjustable-footprint suspension seat frame of claim 1, wherein the first cantilever arm and the second cantilever arm are disposed opposite each other and facing each other on inside surfaces of each cantilever arm.

16. The adjustable-footprint suspension seat frame of claim 15, wherein the backside of the first cantilever arm and the backside of the second cantilever arm include surfaces that are on a side of the first cantilever arm and second cantilever arm that are opposite the inside surfaces of each cantilever arm.

17. The adjustable-footprint suspension seat frame of claim 1, wherein at least a portion the first cantilever arm and at least a portion of the second cantilever arm are disposed at an angle relative to the first footprint adjustment bar.

18. The adjustable-footprint suspension seat frame of claim 17, wherein the angle is 45 degrees.

19. The adjustable-footprint suspension seat frame of claim 17, further comprising transitions which each transition a first portion of the first cantilever arm and a first portion of the second cantilever arm from being parallel to the first footprint adjustment bar to being disposed at an angle at a second portion of the first cantilever arm and at a second portion of the second cantilever arm.

* * * * *